United States Patent [19]

O'Neal, III et al.

[11] 4,191,512

[45] Mar. 4, 1980

[54] APPARATUS AND METHOD FOR CONTROLLING PRESSURE RATIO IN HIGH VACUUM VAPOR PUMPS

[75] Inventors: Charles D. O'Neal, III, Bolton; Leo J. Blumle, Sudbury; Marsbed Hablanian, Wellesley, all of Mass.

[73] Assignee: Varian Associates, Inc., Palo Alto, Calif.

[21] Appl. No.: 828,835

[22] Filed: Aug. 29, 1977

[51] Int. Cl.[2] ..... F04F 9/08

[52] U.S. Cl. ..... 417/54; 219/272; 219/499; 219/501; 219/502; 417/154

[58] Field of Search ..... 417/45, 54, 182, 410, 417/1, 32, 19, 77, 152, 153, 154; 60/202; 219/272, 275, 328, 331, 501, 502, 497, 499; 73/40.7

[56] References Cited

U.S. PATENT DOCUMENTS

| | | | |
|---|---|---|---|
| 728,616 | 2/1903 | Engleman | 219/501 |
| 2,518,597 | 8/1950 | Brooks | 417/32 |
| 2,792,484 | 5/1957 | Gurewitsch et al. | 219/502 |
| 3,275,221 | 9/1966 | Holce | 417/152 X |
| 3,287,660 | 11/1966 | Webb | 219/272 X |
| 3,495,777 | 2/1970 | Evalds et al. | 219/502 X |
| 3,544,236 | 12/1970 | Brookmire | 417/32 |
| 3,553,429 | 1/1971 | Nelson | 219/499 X |
| 3,575,766 | 4/1971 | McArthur et al. | 219/501 |
| 3,859,012 | 1/1975 | Hogg | 417/437 |
| 3,999,190 | 12/1976 | Brown et al. | 219/501 X |
| 4,024,376 | 5/1977 | Radel | 219/272 |

*Primary Examiner*—Carlton R. Croyle
*Assistant Examiner*—Edward Look
*Attorney, Agent, or Firm*—Stanley Z. Cole; Leon F. Herbert; Edward H. Berkowitz

[57] ABSTRACT

A predetermined pressure ratio is maintained between a foreline and a load port of a vacuum diffusion pump including a bath of oil that is vaporized by a heater. A property of the pump is sensed to derive a signal indicative of the pressure ratio. The signal is compared with a set point value to derive an error signal that controls the amount of power continuously supplied by the heater to the oil bath. The sensed property can be the RMS power supplied by the heater, the heat supplied to the bath, or the density of vaporized fluid in the pump.

16 Claims, 3 Drawing Figures

APPARATUS AND METHOD FOR CONTROLLING PRESSURE RATIO IN HIGH VACUUM VAPOR PUMPS

FIELD OF THE INVENTION

The present invention relates generally to vacuum vapor pumps and more particularly to a vacuum vapor pump wherein the power continuously supplied by a heater to the fluid is controlled in response to a sensed signal indicative of a pressure ratio between a foreline and a load port of the pump.

BACKGROUND OF THE INVENTION

It is known in the prior art that the pressure ratio ($P_{IN}/P_{OUT}$) between a foreline and a load port of a vacuum vapor pump having a source of vaporizable fluid, such as a diffusion pump, is a function of the power supplied by a heater to a bath of the vaporizable fluid. Such heaters are usually electrically powered from a unregulated, AC source. As the voltage of the unregulated source varies, the power supplied to the heater varies, with resulting changes in the ratio of $P_{IN}/P_{OUT}$. While it is possible to provide a regulated AC source for the power supplied to the heater, such sources are relatively expensive and frequently do not include provision for varying the power supplied to the heater. Thereby, accurate control of the pressure ratio $P_{IN/POUT}$ is not generally attained with the prior art, and there are difficulties in changing a set point value for the pressure ratio.

BRIEF DESCRIPTION OF THE INVENTION

In accordance with the present invention, a predetermined ratio is maintained between a foreline and a load port of a vacuum vapor pump, having a source of fluid (typically an oil bath) that is vaporized by a heater, by sensing a property of the pump. The sensed property is converted into a signal indicative of the actual pressure ratio between the foreline and the load port. In response to the signal indicative of the actual pressure ratio, power continuously supplied by the heater to the fluid is controlled so that the predetermined ratio is attained. The predetermined pressure ratio may be a set point value that is varied at will over a predetermined range. By utilizing a feedback arrangement for sensing a property of the pump, the expense involved with a regulated power supply for the heater is obviated.

The invention has application particularly to diffusion pumps, and more particularly to diffusion pumps wherein helium partial pressures are involved, such as disclosed in Briggs, U.S. Pat. No. 3,690,151, commonly assigned with the present invention. There are difficulties in measuring helium partial pressure in the foreline of a diffusion pump, because of the high pressure in the foreline, so that the direct approach of measuring the foreline pressure ($P_{OUT}$) and the load pressure ($P_{IN}$) is not feasible. It is, therefore, necessary to determine the ratio of $P_{IN}/P_{OUT}$ indirectly, by sensing properties of the pump that are related to $P_{IN}/P_{OUT}$.

In accordance with one embodiment of the invention, the heat continuously supplied to the source of vaporizable fluid is controlled by sensing the RMS power supplied to an electric heater for the vaporizable fluid. The RMS power supplied to the heater is directly proportional to the power continuously supplied by the heater to the vaporizable fluid.

In accordance with another embodiment of the invention, the power supplied to the vaporizable fluid is determined with a thermal sensor, such as a thermocouple, that is embedded in a heater which supplies power to the vaporizable fluid via a metal block that forms a high thermal conductivity path. It is necessary to isolate the thermal sensor from the fluid because the temperature of the heater, and not the fluid, must be monitored. Monitoring the temperature of the fluid does not indicate how much power is supplied by the heater to the fluid because the fluid temperature has a large thermal capacitance and a tendency to have a constant temperature for long time periods, independently of the heat supplied to it.

The power, P, supplied by the heater to the vaporizable fluid is related to $P_{IN}$ and $P_{OUT}$ in accordance with:

$$P_{IN}/P_{OUT}=K_1e^{K_2P}$$

where:

$K_1$ and $K_2$ are constants determined by parameters of the pump, and e is the base of natural logarithms. The values of $K_1$ and $K_2$ in a typical diffusion pump are selected to provide a pump having high sensitivity; the sensitivity is such that a change in the power supplied to the heater by a factor of two causes a change in the ratio $P_{IN}/P_{OUT}$ by an order of magnitude or more. Because of the values of $K_1$ and $K_2$, an unregulated power supply for the heater causes severe changes in the value of $P_{IN}/P_{OUT}$, which are overcome with the invention.

Although it is known to control the temperature of a pool of vaporizable fluid in a high vacuum vapor pump, to maintain the vapor temperature within a desired range, this prior art vapor temperature control appears to do little to stabilize the pressure ratio $P_{IN}/P_{OUT}$. The prior art temperature control for the fluid of the pool utilizes a thermostatic switch in contact with the fluid of the pool to sense the temperature of the fluid in the pool and control whether current is supplied or is not supplied to the heater. The thermostatic switch may actually degrade stabilization of the pressure ratio $P_{IN}/P_{OUT}$ because a thermostatic switch cannot compensate for small changes in the voltage of an unregulated AC power supply. Such a switch causes the power supplied to the heater to be either fully on or fully off for relatively long time periods, depending upon whether the temperature of the fluid in the pool is below or above a desired temperature condition. These severe variations in the power supplied to the heater are reflected in substantial variations in the ratio $P_{IN}/P_{OUT}$. Further, the temperature sensing for the fluid in the pool is an ineffective approach because the density of the vapor emanating from jets of a diffusion pump, and therefore pressure of the fluid or oil in the boiler, controls the ratio $P_{IN}/P_{OUT}$. The density of the vapor emanating from the jets of the pump is a function of the quantity of vapor boiled from the boiler. The temperature of the fluid in the boiler remains almost constant, independent of energy input, at the point of phase change from liquid to vapor for the fluid. By controlling the power supplied to the heater so that power is continuously, rather than intermittently, supplied to the heater, there is continuous control for the amount of vapor derived from the fluid of the oil bath.

In accordance with another embodiment of the invention, the ratio $P_{IN}/P_{OUT}$ is indirectly determined by sensing the density of oil vapor leaving the pool, and prior to flowing through any of the nozzles of a diffusion pump. Such a density measurement can be provided e.g. by a conventional ion source and detector in the vapor stream downstream of the pool and upstream of the diffusion pump jets.

It is, accordingly, an object of the present invention to provide a new and improved apparatus for and method of maintaining a predetermined pressure ratio between a foreline and a load port of a vacuum vapor pump having a source of fluid that is vaporized by a heater.

Another object of the invention is to provide a closed loop, negative feedback apparatus for maintaining a predetermined pressure ratio between a foreline and a load port of a vacuum vapor pump having a source of fluid that is vaporized by a heater.

Another object of the invention is to provide a feedback controller for maintaining a predetermined ratio between a foreline and a load port of a vacuum vapor pump having a source of vaporizable fluid, wherein the feedback control is performed indirectly, without measuring either of the pressures.

A further object of the invention is to provide an apparatus for and method of maintaining a predetermined pressure ratio between a foreline and a load port of a vacuum vapor pump having a source of fluid that is vaporized by a heater, wherein a property of the pump is sensed to control the amount of heat continuously supplied to the heater.

Still another object of the invention is to provide an apparatus for maintaining a predetermined pressure ratio over a range of set points, between a foreline and a load port of a vacuum vapor pump having a source of fluid that is vaporized by a heater.

DETAILED DESCRIPTION OF THE INVENTION

Figure 1:
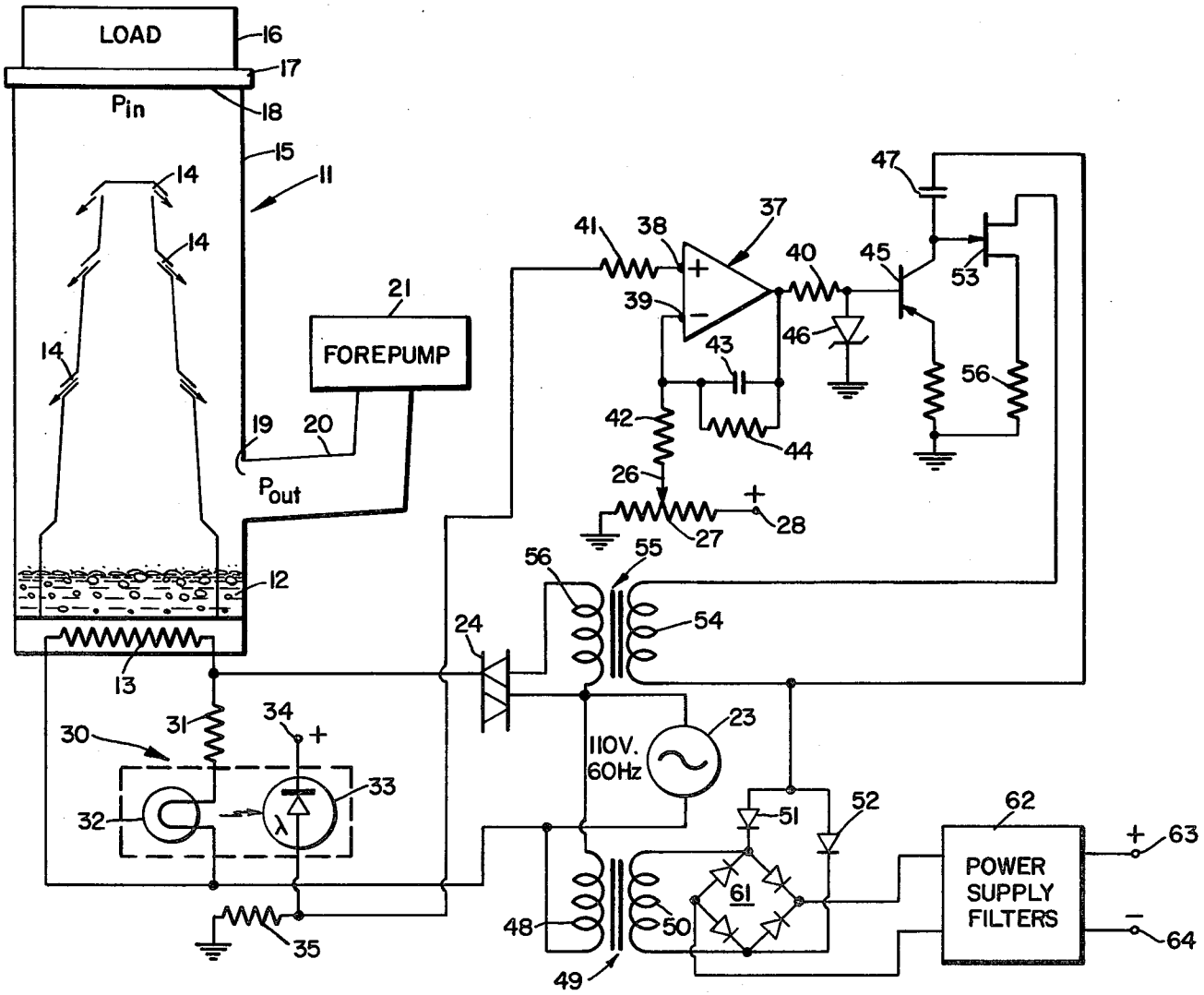
FIG. 1 is a block diagram of a preferred embodiment of the invention.

Reference is now made to FIG. 1 of the drawing wherein there is illustrated a diffusion pump 11 of a conventional type, and which includes an oil bath or pool 12 of vaporizable fluid that is heated to a vapor state by electric, resistance heater 13. The vaporized fluid from pool 12 flows through diffusion nozzles 14 against the wall of a cylindrical chamber for pump 11. The vapor condenses on a cylindrical wall of casing 15 and flows downwardly into pool 12, where it is again heated, in a conventional manner. Load 16, that is being pumped to a relatively low pressure (typically on the order of $10^{-6}$ torr), is connected by flange 17 to an inlet port 18 at the top of casing 15. The wall of casing 15 includes an outlet port 19, which is positioned between the lowermost nozzle 14 and the top of pool 12, and which is connected to foreline 20 that is evacuated by fore pump 21. All of the foregoing structure is well known to those skilled in the art, and is provided for background.

In accordance with the present invention, the ratio $P_{IN}/P_{OUT}$ of the pressures at ports 18 and 19, is maintained constant; where:

$P_{IN}$ equals the pressure at port 18, and $P_{OUT}$ equals the pressure at port 19. The ratio $P_{IN}/P_{OUT}$ is maintained at a predetermined, settable level by controlling the power supplied by heater 13 to pool 12. By controlling the power continuously supplied by heater 13 to pool 12, the ratio $P_{IN}/P_{OUT}$ is controlled in accordance with:

$$P_{IN}/P_{OUT}=K_1e^{K_2P}$$

where:

$K_1$ and $K_2$ are parameters controlled by the characteristics of pump 11, e equals the base of natural logarithms, and P equals the power continuously supplied by heater 13 to pool 12.

In accordance with the embodiment of FIG. 1, the power supplied to pool 12 is controlled by controlling the RMS power supplied to conventional heater 13. To this end, the RMS power supplied to heater 13 is sensed and compared with a set point value to derive an error signal that controls the power continuously supplied to the heater from an unregulated, AC source 23, such as a 110 volt, 60 Hz, AC line. The power from source 23 is coupled to heater 13 via Triac 24, series connected between the source and heater. Triac 24 includes a gate electrode that is responsive to a signal indicative of the RMS power supplied to heater 13 and a set point level for the power, as determined by a DC voltage derived from slider 26 of potentiometer 27, connected across a DC source at terminal 28 and ground.

The RMS power coupled to heater 13 is monitored by circuit 30 that shunts the heater, and which comprises series resistor 31 and incandescent lamp 32. The intensity of the light derived from lamp 32 is instantaneously indicative of the power supplied to heater 13. Light from lamp 32 is coupled via a shielded optical path to a semiconductor photocell 33, having one electrode connected to a DC source at terminal 34, and a second electrode connected to load resistor 35. Photocell 33 has a relatively long response time, so that the voltage developed across resistor 35 is directly proportional to the RMS power supplied to heater 13.

The voltage across resistor 35, indicative of the RMS power supplied to heater 13, is compared with a set point value for the power input to heater 13 (which in turn is directly proportional to the power supplied by heater 13 to pool 12), as derived from slider 26. The comparison is performed in differential amplifier 37, having non-inverting and inverting input terminals 38 and 39, respectively responsive to the DC voltages across resistor 35 and at slider 26, as coupled to the terminals by series resistors 41 and 42. Amplifier 37 derives an error signal proportional to the difference between resistor 35 and slider 26, and includes a negative feedback path including the parallel combination of capacitor 43 and resistor 44 that smooth any short-term fluctuations in the difference between the input signals to the amplifier.

The DC, differential output of amplifier 37 is applied to the base of PNP transistor 45, which is protected by series resistor 40 and by shunt Zener diode 46. The collector of transistor 45 is coupled by capacitor 47 to an unfiltered, full wave, rectified replica of the voltage derived from source 43. The full wave replica is derived by connecting source 23 across primary winding 48 of transformer 49, having a secondary winding 50 with opposite ends connected to the cathodes of diodes 51 and 52. The anodes of diodes 51 and 52 are connected directly together, and to the other electrode of capacitor 47.

Capacitor 47 is charged to a level indicative of the differential, error voltage derived from amplifier 37, which level is superimposed on the full wave rectified voltage derived from the anodes of diodes 51 and 52. The full wave rectified voltage coupled through capacitor 47 and the error voltage at the collector of the transistor 45, resulting from the output of amplifier 37, are combined to control the firing time of a voltage responsive switch, in the form of unijunction transistor 53. The voltage at the collector of transistor 45 is fed directly to the gate electrode of unijunction transistor 53 whereby the unijunction transistor is activated into a conducting state between its output electrodes once during each half cycle of the full wave rectified voltage coupled to capacitor 47. The time at which gate 48 is rendered conductive during each half cycle is determined by the magnitude of the error voltage. One output electrode of unijunction transistor 53 is connected through primary winding 54 of transformer 55 to the anodes of diodes 51 and 52. The other output electrode of unijunction transistor 53 is connected to ground through resistor 56.

By connecting the output electrodes of unijunction transistor 53 to the junction at the anodes of diodes 51 and 52 through transformer 54, cut-off of the unijunction transistor is assured during each half cycle of AC source 23. Also, if there are power supply fluctuations, the voltages applied to the output terminals of unijunction transistor 53 follow variations of the full wave rectified voltage coupled via capacitor 47 to the gate electrode of the unijunction transistor. From the foregoing, during each half cycle of the 60 Hz source 23, winding 54 is responsive to timing pulses with a leading edge having a time position, relative to the zero axis crossing of source 23, that is effectively controlled by the error voltage derived from amplifier 37 and is inversely related to the amplitude of AC source 28. The trailing edge of each of the timing pulses is fired relative to each half cycle of source 23.

The timing pulses are coupled by secondary winding 56 of transformer 55 to the gate electrode of Triac 24 to control the duty cycle of each half cycle of current flowing from source 23 to heater 13. In particular, Triac 24 is activated into a conducting state once during each half cycle of source 23, at a time primarily dependent upon the magnitude of the error voltage derived from amplifier 37, and is slightly dependent upon the amplitude of the AC source. The duty cycle dependency on the amplitude of AC source 23 is slightly compensated by the amplitude of the current supplied by source 23 and Triac 24 to heater 13. By controlling the conduction time of Triac 24 during each half cycle of source 23, the power continuously supplied by the source of heater 13 and the pressure ratio $P_{IN}/P_{OUT}$ are controlled at a value determined by the setting of slider 26 of potentiometer 27.

Amplifier 37, and other circuits requiring DC power that are associated with pump 11, are energized by a DC source that is formed by connecting full wave rectibridge 61 across secondary winding 50 of transformer 49. Bridge 61 includes an apex, across which a DC voltage is derived; the apex is connected to appropriate power supply filter circuits 62, having output terminals 63 and 64 for positive and negative DC power supply voltages.

Figure 2:
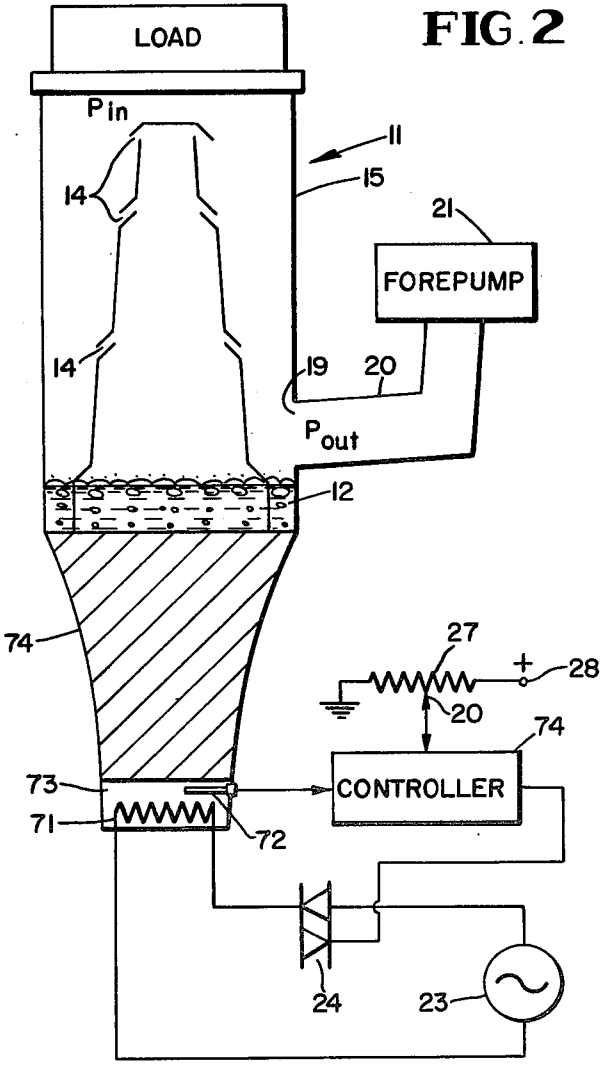
FIG. 2 is a block diagram of the invention wherein a thermal sensor for the heater is provided.

In accordance with another embodiment of the invention, as illustrated in FIG. 2, the heat supplied to electric heater 71 is directly monitored by a suitable thermal sensing means, such as thermocouple 72. Thermocouple 72 and heater 71 are located in a heating block 73 that supplies heat to oil pool 12 of diffusion pump 11 via a metal block 75 having an intermediate thermal conductivity such as is provided by iron. There is a resulting flow of heat from block 73 through metal block 74 to oil bath 12. It is necessary to isolate thermal sensor 72 from bath 12, by block 74, so that the power supplied to heater 71 and, therefore, the heat supplied to pool 12, is monitored. Inaccuracies would occur if the temperature of the liquid in pool 12 were monitored directly because the pool has a high thermal capacitance, whereby the temperature of pool 12 does not provide an indication of the power instantaneously supplied to the pool.

The output signal of thermocouple 72, a DC voltage indicative of the power supplied to pool 12, is compared with a set point value, as derived from slider 26 of potentiometer 27. The comparison is performed in controller 74 which has the same configuration as the controller of FIG. 2. Thereby, controller 74 derives, during each half cycle of AC source 23, a timing wave having a leading edge that is displaced with respect to the zero crossing axis of the AC output of source 23 by an amount indicative of the difference between the voltages derived from thermocouple 72 and slider 26. The timing wave controls the firing time of Triac 24 during each half cycle of source 23, to control the power continuously supplied to heater 71 and bath 12.

Figure 3:
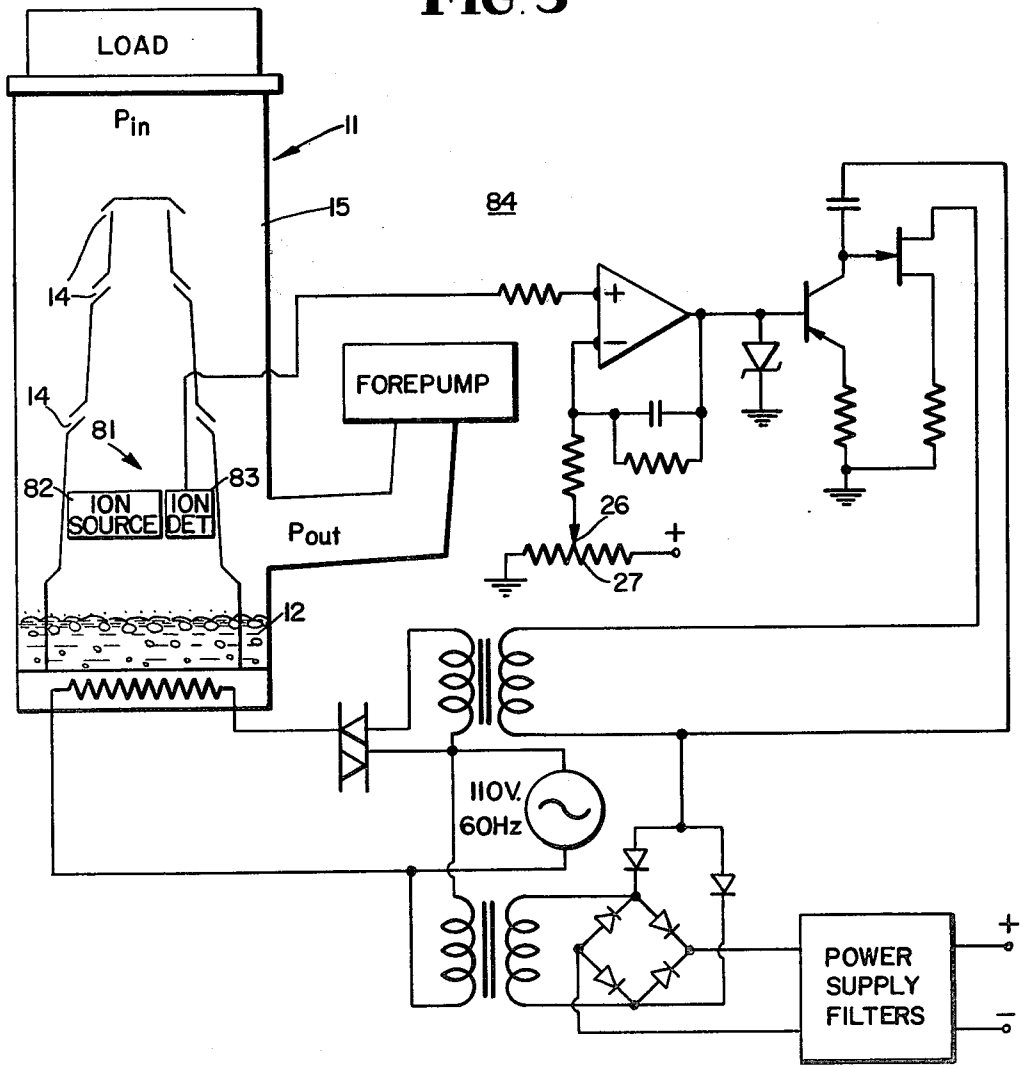
FIG. 3 is a block diagram of a modified controller in accordance with the invention, wherein a vapor density gauge is employed.

In accordance with a further modification of the invention, as illustrated in FIG. 3, the power supplied to oil pool 12 is controlled as a function of the density of the vapor of the pump. In one configuration, the density of the oil vapor is determined by placing a density gauge 81 in the flow path for vapor from pool 12 to nozzles 14. The density gauge includes an ion source 82, such as an isotope source, and an ion detector 83. A beam from ion source 82 to detector 83 is tranverse to the general flow direction of vaporized molecules flowing from pool 12 to nozzles 14. Alternatively the density gauge 81 is downstream of one of nozzles 14 and upstream of condensing casing wall 15. The latter configuration may be advantageous because of the considerable lower total pressure downstream of the jets.

Detector 83 derives a DC level related to the density of the vapor stream. The DC output signal of detector 83 is coupled as an input to controller 84 that has the same configuration as the controller of FIG. 1. In the controller, the DC output signal of detector 83 is compared with a set point value, as derived from slider 26 of potentiometer 27. The controller derives a signal exactly as described in connection with FIGS. 1 and 2 to control the triggering time of Triac 24 during each half cycle of AC source 23.

While there have been described and illustrated several specific embodiments of the invention, it will be clear that variations in the details of the embodiments specifically illustrated and described may be made without departing from the true spirit and scope of the invention as defined in the appended claims.

What is claimed is:

1. Apparatus for maintaining a predetermined pressure ratio between an inlet port and an output port of a vacuum vapor pump having a source of fluid that is vaporized by a heater comprising sensing means responsive to a property of the pump indicative of the actual pressure ratio for deriving a signal indicative of the actual pressure ratio, and means responsive to the signal for controlling power continuously supplied by the heater to the fluid source so that the predetermined ratio is attained.

2. The apparatus of claim 1 further including means for varying a set point value for the predetermined pressure ratio.

3. The apparatus of claim 1 wherein the controlling means includes means for comparing the signal with a parameter indicative of the predetermined pressure ratio to derive an error signal that controls the heater.

4. The apparatus of claim 1 wherein the property sensing means includes means for sensing the RMS power supplied to the heater.

5. The apparatus of claim 1 further including a mass of metal positioned between he heater and the fluid source so that heat flows from the heater to the fluid source through the mass and the heater is remote from the fluid source, and the means for sensing includes means for sensing the temperature of the heater.

6. The apparatus of claim 1 wherein the sensing means includes means for sensing the density of vaporized fluid.

7. The apparatus of claim 1 wherein the heater is an electric heater adapted to be connected to an unregulated AC source, said means for sensing including means for sensing the RMS power supplied by the AC source to the electric heater, said means for controlling including means for controlling the RMS power supplied by the AC source of the electric heater.

8. The apparatus of claim 7 wherein the means for sensing includes an incandescent lamp connected in shunt with the heater so that the average intensity of the light emitted from the lamp is indicative of the power supplied to the heater, and photocell means for sensing the average intensity of the light emitted from the lamp to derive the signal.

9. The apparatus of claim 8 wherein the controlling means includes means responsive to the AC source for deriving an unfiltered, full wave replica of the AC source, means responsive to the signal and a set point indicative of the predetermined ratio for deriving a DC error signal, and means responsive to the replica and the error signal for controlling the duty cycle of the power supplied by the AC source to the heater.

10. The apparatus of claim 7 wherein the controlling means includes means responsive to the AC source for deriving an unfiltered, full wave replica of the AC source, means responsive to the signal and a set point indicative of the predetermined ratio for deriving a DC error signal and means responsive to the replica and the error signal for controlling the duty cycle of the power supplied by the AC source to the heater.

11. A method of maintaining a predetermined pressure ratio between an inlet port and an outlet port of a vacuum vapor pump having a source of fluid that is vaporized by a heater comprising sensing a property of the pump indicative of the pressure ratio, and controlling power continuously supplied by the heater to the fluid source in response to the sensed property to attain the predetermined ratio.

12. The method of claim 11 wherein the power is controlled by comparing the sensed property with a parameter indicative of the predetermined ratio.

13. The method of claim 11 wherein the sensed property is the RMS power supplied to the heater.

14. The method of claim 11 wherein the heater is remote from the fluid and heat flows from the heater to the fluid via a mass of metal and the sensed property is the temperature of the heater.

15. The method of claim 11 wherein the sensed property is the density of vaporized fluid.

16. The method of claim 11 wherein the heater is an electric heater connected to an unregulated AC source, said property being the RMS power supplied by the AC source to the electric heater, and controlling the RMS power supplied by the AC source to the electric heater.

* * * * *